US006662616B2

(12) United States Patent
Böhlke et al.

(10) Patent No.: US 6,662,616 B2
(45) Date of Patent: Dec. 16, 2003

(54) METHOD AND DEVICE FOR FLEXIBLY ROLLING A METAL BAND

(75) Inventors: Peter Böhlke, Aachen (DE); Alexander Ebert, Düsseldorf (DE); Andreas Hauger, Aachen (DE); Reiner Kopp, Aachen (DE)

(73) Assignee: Muhr und Bender KG, Attendorn (DE)

( * ) Notice: Subject to any disclaimer, the term of this patent is extended or adjusted under 35 U.S.C. 154(b) by 0 days.

(21) Appl. No.: 09/934,454

(22) Filed: Aug. 22, 2001

(65) Prior Publication Data

US 2002/0023472 A1 Feb. 28, 2002

(30) Foreign Application Priority Data

Aug. 22, 2000 (DE) ..... 100 41 280

(51) Int. Cl.[7] ..... B21B 31/07
(52) U.S. Cl. ..... 72/240; 72/205; 72/366.2
(58) Field of Search ..... 72/205, 240, 246, 72/248, 249, 365.2, 366.2, 252.5

(56) References Cited

U.S. PATENT DOCUMENTS

| | | | | | |
|---|---|---|---|---|---|
| 3,499,305 A | * | 3/1970 | Abernathy | ..... | 72/240 |
| 3,866,451 A | * | 2/1975 | Winter et al. | ..... | 72/199 |
| 4,041,749 A | * | 8/1977 | Veitl | ..... | 72/187 |
| 4,266,418 A | * | 5/1981 | Sakai et al. | ..... | 72/197 |

FOREIGN PATENT DOCUMENTS

| | | | | |
|---|---|---|---|---|
| DE | 457 669 | | 3/1928 | |
| DE | 2 245 650 | | 3/1973 | |
| DE | 198 46 900 | | 8/2000 | |
| JP | 58-61911 | * | 4/1983 | ..... 72/240 |
| JP | 59-107705 | * | 6/1984 | ..... 72/240 |
| JP | 62-21403 | * | 1/1987 | ..... 72/240 |

OTHER PUBLICATIONS

"Das Schubwalzen—ein neues Walzverfahren", Aluminum 56 Jahrg 1980.

* cited by examiner

*Primary Examiner*—Ed Tolan
(74) *Attorney, Agent, or Firm*—Nixon Peabody LLP; David S. Safran

(57) ABSTRACT

A method and a device for flexibly rolling a metal band by guiding the metal band through a roll gap formed between a first working roll and a second working roll, and by varying the size of the roll gap in such a way that band sections with a greater band thickness and band sections with a lesser band thickness are obtained over the length of the metal band. In the device and method, the time of contact between each point on the circumference of the first working roll and the metal band is shorter in duration than the time of contact between each point on the circumference of the second working roll and the metal band such that an asymmetric band thickness profile is obtained in a region of the band sections with a lesser band thickness.

15 Claims, 2 Drawing Sheets

METHOD AND DEVICE FOR FLEXIBLY ROLLING A METAL BAND

BACKGROUND OF THE INVENTION

1. Field of the Invention

The invention pertains to a method for flexibly rolling a metal band, wherein the metal band is rolled by guiding it through a roll gap formed between a first working roll and a second working roll, and wherein the size of the roll gap is varied in such a way that band sections having a greater band thickness and band sections with a lesser band thickness are obtained over the length of the metal band. The invention also pertains to a device for flexibly rolling a metal band and which includes a first working roll and a second working roll, wherein a roll gap, through which the metal band can be guided in order to be rolled, is formed between the first working roll and the second working roll, and wherein the size of said roll gap can be varied in such a way that band sections with a greater band thickness and band sections with a lesser band thickness are obtained over the length of the metal band.

2. Description of the Related Art

A flexible rolling method for manufacturing metal bands with band thicknesses that differ over its length in a defined fashion is already known from practical applications and characterized by the fact that the roll gap, i.e., the distance between the first working roll and the second working roll, is varied in a targeted fashion during the rolling process in order to obtain different band thicknesses over the length of the metal band. This can be realized indirectly, namely in the form of changing the deformation resistance of the material by heating or cooling the metal band and correspondingly changing the spring travel of the roll stand during the rolling process. In this case, the temperature of the material to be rolled may lie below or above the recrystallization temperature. However, the roll gap can also be varied directly with the aid of at least one working roll, i.e., by displacing a working roll perpendicular to the rolling direction.

In flexible rolling processes, band sections with, as described above, different band thicknesses are rolled. These band sections may be connected to one another by different inclines such that there exist many options for realizing the band thickness profile. The purpose of flexible rolling processes is to obtained manufacturing rolled products with cross-sectional shapes that are optimized with respect to their load carrying capacity and/or weight. Flexible rolling processes allow a faster manufacture of metal bands with a defined thickness profile in the longitudinal rolling direction which is individually adapted to the respective load bearing capacity for each component. After the band is correspondingly treated, these metal bands are separated into billets. Billets manufactured in this fashion are not only suitable for the automotive industry, but also for the aeronautical and aerospace industry, as well as wagon building. These billets can be formed by corresponding additional processing steps, e.g., deep-drawing, stretch-forming, internal high-pressure forming or high-pressure sheet forming. The manufacture of the profiles in only one step significantly contributes to the high economic potential of this manufacturing technology. The technological advantages can, in particular, be seen in the constant material properties of the material to be rolled, the applicability to all rollable materials and the high flexibility of the manufacturing method.

Flexible rolling methods are usually designed such that the metal band is rolled from coil to coil. However, other variations, e.g., coil to billet or billet to billet, are also known. In the rolling from coil to coil, the band tension caused by the coiler favorably influences the rolling process and contributes to a significant improvement in the surface evenness of the finished metal band in the longitudinal direction, i.e., in the rolling direction. In other respects, the flexible rolling from coil to coil simultaneously ensures a high productivity because the thickness profiles are continuously produced in the metal band.

In the manufacture of automobiles, the permissible tolerances with respect to the component geometry and/or the required surface evenness, as well as the particularly high surface quality associated therewith, become continuously stricter. This means that flexibly rolled billets are required which have an asymmetric band thickness profile. If a billet or a metal band has an asymmetric band thickness profile, a greater band thickness transition is realized on one side of the metal band than on the other side when a band section with greater band thickness transforms into a band section with lesser band thickness, and vice versa. In borderline instances, one side of the metal band does not contain any band thickness transitions at all, i.e., it is completely plane. The following description exclusively refers to metal bands with asymmetric band thickness profiles, wherein billets with asymmetric band thickness profiles are also covered by this term.

In flexible rolling methods known from the state of the art, the forming zone is defined by the distance between the working rolls on one hand and by the working roll diameters on the other hand. Due to significantly different flow resistances of the metal band in the longitudinal direction and in the transverse direction, the vertically displaced material essentially flows entirely in the longitudinal direction and not in the lateral direction. When using conventional working rolls with identical diameters, the forming zone in the roll gap lies symmetric to the central plane of the metal band. This means that the material of the metal band is uniformly stretched in the longitudinal direction over the entire cross section if the different translational motions are neglected. Metal bands with symmetric band thickness profiles cannot be produced in this fashion.

Published German Patent Application 2 245 650 discloses a method for manufacturing metal bands that contain band sections with an asymmetric band thickness profile. In this method, stepped sheets are manufactured in the reversing mode by means of hot-rolling while observing a rolling end temperature between 850° C. and 1050° C. If the initially symmetric metal band is transported onto the roller table that follows the roll stand beforehand with its band section of greater band thickness, the region of lesser band thickness is lowered until it contacts the rollers of the roller table. Such a lowering also takes place in the transition between the region with a greater band thickness and the region with a lesser band thickness such that the undersides of the region with a greater band thickness, of the transition region and of the region with a lesser band thickness form an essentially straight line. The disadvantages of this method can be seen in the fact that it is limited to hot-rolling processes, and that the yield is relatively low—due to the complicated interruption of the rolling process.

In another method known from the state of the art, asymmetric band thickness profiles are obtained due to the fact that individual beveled slabs are welded to one another and subsequently rolled plane. However, the asymmetric band thickness profile is only obtained after the welded slabs are separated. The disadvantage of this method can be seen in the required expenditure of force and labor which is twice as high in this case.

SUMMARY OF THE INVENTION

The present invention is based on the objective of providing a method and a corresponding device for flexibly rolling a metal band which make it possible to easily obtain an asymmetric band thickness profile in cold-rolling processes and hot-rolling processes.

The method in accordance with the present invention for attaining the above-mentioned objective is characterized by the fact that, in order to obtain band sections with a lesser band thickness, the time of contact between each point on the circumference of the first working roll and the metal band is shorter than the time of contact between each point on the circumference of the second working roll and the metal band such that an asymmetric band thickness profile is obtained in the region of the band sections with a lesser band thickness. A metal band with an asymmetric band thickness profile which is manufactured with the method in accordance with the invention specifically has a shape in which the band thickness transition on the side of the metal band which faces the first working roll is greater than the band thickness transition on the side of the metal band which faces the second working roll.

In accordance with the present invention, it was recognized that a longer time of contact between the metal band and the working roll makes it more difficult for the material of the metal band to flow in the longitudinal direction of the metal band than a shorter time of contact, i.e., it becomes more difficult to stretch the metal band in the longitudinal direction. In order to manufacture a metal band with first band sections that have a greater band thickness and a symmetric band thickness profile and second band sections with a lesser band thickness and an asymmetric band thickness profile, the invention proposes to utilize a conventional rolling process for producing the first band sections and to reduce the roll gap in order to produce the second band sections, with an additional measure being taken for producing the second band sections which results in the time of contact between the metal band and the first working roll to be shorter than the time of contact between the metal band and the second working roll.

If it is intended to manufacture a flexibly rolled metal band that is completely plane on one side, i.e., a metal band that only contains band thickness transitions on one side, the adjustments should be chosen such that the time of contact between each point on the circumference of the first working roll and the metal band is so short and the time of contact between each point on the circumference of the second working roll and the metal band is so long that band thickness transitions are exclusively produced on the side of the metal band which faces the first working roll. During the operation of the rolling device, such adjustments can be easily and rapidly realized by varying, i.e., extending or shortening, the times of contact between the points on the circumference of the working roll and the metal band until the desired surface evenness is achieved on one side of the metal band.

The method in accordance with the present invention which was described above in general terms can be specifically realized in different embodiments. A first embodiment for realizing the method in accordance with the invention includes operating with different circumferential speeds of the working rolls, namely such that the circumferential speed of the first working roll is faster than the circumferential speed of the second working roll. If working rolls with identical diameters are used and the metal band is centrally guided through the roll gap, i.e., along the checking line of the roll gap formed by the plane of symmetry between the two working rolls, it is quite obvious that the time of contact between each point on the circumference of the first working roll and the metal band is longer than the time of contact between each point on the circumference of the second working roll and the metal band due to the circumferential speed of the first working roll.

It would also be possible to choose the diameter of the first working roll smaller than that of the second working roll. However, if the diameter of the second working roll is smaller than the diameter of the first working roll, a minimum radius of the second working roll which depends on the difference between the circumferential speeds of the two working rolls and the radius of the first working roll needs to be observed. This requirement regarding the minimum radius of the second working roll is, as described in greater detail below, based on the notion that the contact region in which the metal band lies on the circumferential region of the working roll becomes smaller as the radius of a working roll decreases. Consequently, the contact surface of the metal band on a working roll increases proportionally with the radius of the working roll. Observing the borderline instance of a working roll with an infinitely large radius can easily elucidate this. This would result in a completely plane surface that supports the metal band over its entire length. With respect to the requirement that the metal band is guided through the roll gap between the two working rolls along the checking line, i.e., the line or plane of symmetry, deviations within a certain range are also possible as described below.

Another embodiment option for realizing the method in accordance with the invention consists of operating such that the length of the metal band compressed by the first working roll is shorter than the length of the metal band compressed by the second working roll in order to obtain band sections with a lesser band thickness. If one observes the simplest instance, namely that the circumferential speeds of both working rolls are identical and both working rolls have the same diameter, it becomes evident that the time of contact between each point on the circumference of the first working roll and the metal band is shorter than the time of contact between each point on the circumference of the second working roll and the metal band due to the shorter length of the metal band being compressed by the first working roll in comparison to the length of the metal band being compressed by the second working roll. Naturally, certain deviations regarding the circumferential speeds of both working rolls are possible in accordance with the above-described embodiments. The method in accordance with the invention can always be realized by driving the first working roll with a higher circumferential speed than the second working roll. However, if the second working roll should have a higher circumferential speed than the first working roll, one has to take into consideration a maximum value for the circumferential speed of the second working roll. This maximum value depends on the speed of the first working roll, as well as the ratio between the diameters of both working rolls.

There exist other embodiments for realizing and additionally developing the method in accordance with the invention. One particular embodiment or additional development of the method in accordance with the present invention is characterized by the fact that the metal band is subjected to an excursion from the checking line of the roll gap, namely in the direction away from the first working roll, before and/or after the roll gap formed between the first working roll and the second working roll. As described above, the checking line describes the line of symmetry of the roll gap which is defined by the plane of symmetry between the two working rolls. In accordance with this preferred embodiment or additional development of the invention, an excursion toward the second working roll consequently is realized before or after the oppositely arranged working rolls.

Due to this measure, the metal band adjoins the second working roll over a larger circumferential region. Realizing such an excursion of the metal band toward the second working roll before and after the oppositely arranged working rolls may intensify this effect. In this context, the excursion of the metal band from the checking line of the roll gap may be varied during the rolling process, namely with respect to an excursion of the metal band before or after the working rolls, as well as with respect to an excursion of the metal band before and after the working rolls. As a result, the band thickness transitions on the side of the metal band which faces the first working roll can be varied by displacing the first working roll perpendicular to the rolling direction. In addition, this also makes it possible to obtain and vary band thickness transitions on the side of the metal band which faces the second working roll.

The method in accordance with the present invention can be realized by merely choosing the diameter of the first working roll smaller than the diameter of the second working roll. As indicated above, a smaller diameter of a working roll results in a more intense curvature of the working roll circumference, i.e., the contact surface of the metal band that moves over such a roll is smaller than with a working roll that has a larger diameter. Although a first working roll with a smaller diameter than that of the second working roll represents an independent solution, working rolls with diameters that deviate from one another may, as also described above, be suitably combined with other measures in accordance with the present invention.

The flexible rolling device for attaining the above-mentioned objective is characterized by the fact that, in order to obtain band sections with a lesser band thickness, the time of contact between each point on the circumference of the first working roll and the metal band is shorter than the time of contact between each point on the circumference of the second working roll and the metal band such that an asymmetric band thickness profile can be achieved in the region of the band sections with a lesser band thickness. Preferred embodiments and additional developments of the device in accordance with the present invention for flexibly rolling a metal band are realized analogous to the preferred additional developments of the method in accordance with the present invention.

There exist various options for realizing and additionally developing the method in accordance with the present invention and the device in accordance with the invention. In this respect, the following detailed description of preferred embodiments of the invention which refers to the accompanying figures of the drawing.

DETAILED DESCRIPTION OF THE INVENTION

Figure 1:
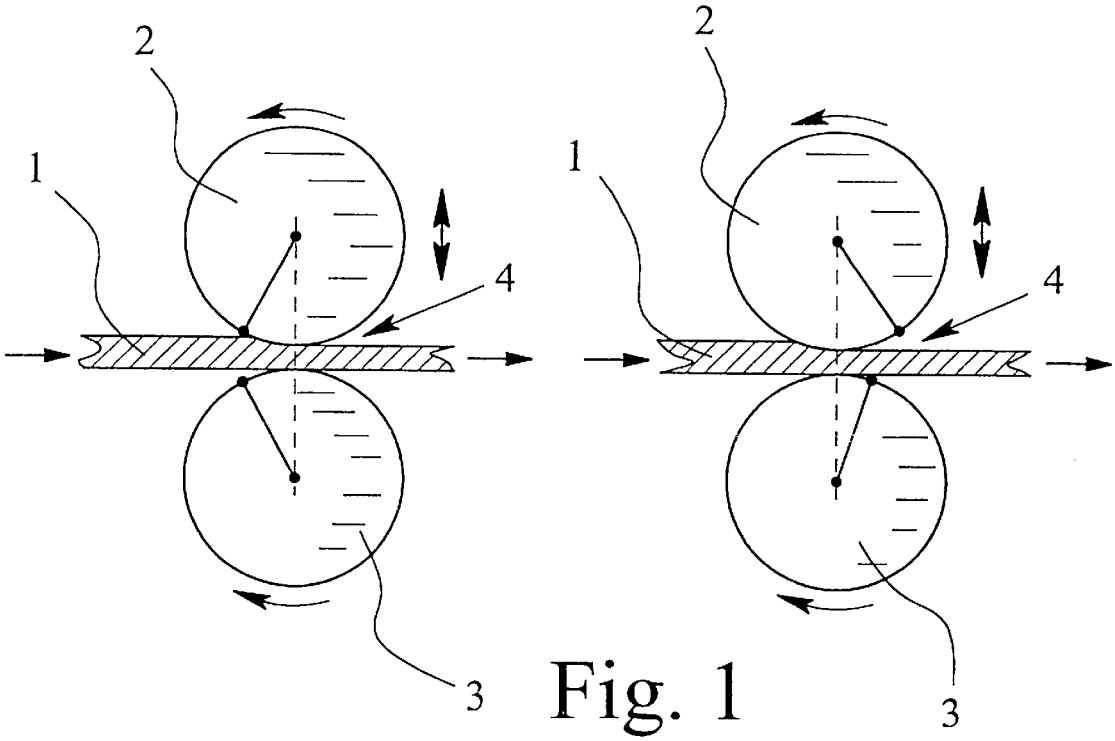
FIG. 1 is a schematic representation of a method and a device in accordance with a first preferred embodiment of invention, wherein both working rolls operate with different circumferential speeds.

FIG. 1 schematically shows a method and a device in accordance with a first preferred embodiment of the invention in which a metal band 1 is guided between a first working roll 2 and a second working roll 3, namely through a roll gap 4 formed between the first working roll 2 and the second working roll 3. The diameter of the first working roll 2 is identical to the diameter of the second working roll 3. The first working roll 2 can be adjusted perpendicular to the longitudinal direction of the metal band 1, i.e., perpendicular to the rolling direction, as is known from conventional flexible rolling processes. Support rolls that are not illustrated in detail may also be provided above the first working roll 2 and underneath the second working roll 3 as it is also known from the state of the art.

The method in accordance with the first preferred embodiment of the invention the circumferential speed of the first working roll 2 is faster than the circumferential of speed of the second working roll 3. This results in each point on the circumference of the first working roll 2 being in contact with the metal band 1 for a shorter time than each point on the circumference of the second working roll 3. This is schematically illustrated in FIG. 1 by two corresponding points on the circumference, namely one point on the circumference of the first working roll 2 and one point on the circumference of the second working roll 3, and the assigned radius. This radius forms an identical angle with a line that extends perpendicular to the checking line of the roll gap and through the center of the first working roll 2 and the second working roll 3, respectively, and is drawn with broken lines in FIG. 1.

If a metal band 1 is guided through the roll gap 4 between the first working roll 2 and the second working roll 3 from the left toward the right, the faster circumferential speed of the first working roll 2 causes the point on the circumference of the first working will 2 to already lose contact with the metal band 1 at a time at which the point on the circumference of the second working roll 3 is still in contact with the metal band 1. As schematically illustrated in FIG. 1, the faster circumferential speed, with which the first working roll 2 acts upon the side of the metal band 1 which faces the first working roll, causes a stretching and consequently a reduction in the band thickness on the side of the metal band 1 which faces the first working roll 2. Due to the slower circumferential speed of the second working roll 3 and the associated longer time of contact between the second working roll 3 and the side of the metal band 1 which faces the second working roll, flowing of the material does not take place on this side of the metal band 1 such that no band thickness transition is produced on this side of the metal band 1, i.e., this side is plane.

Figure 2:
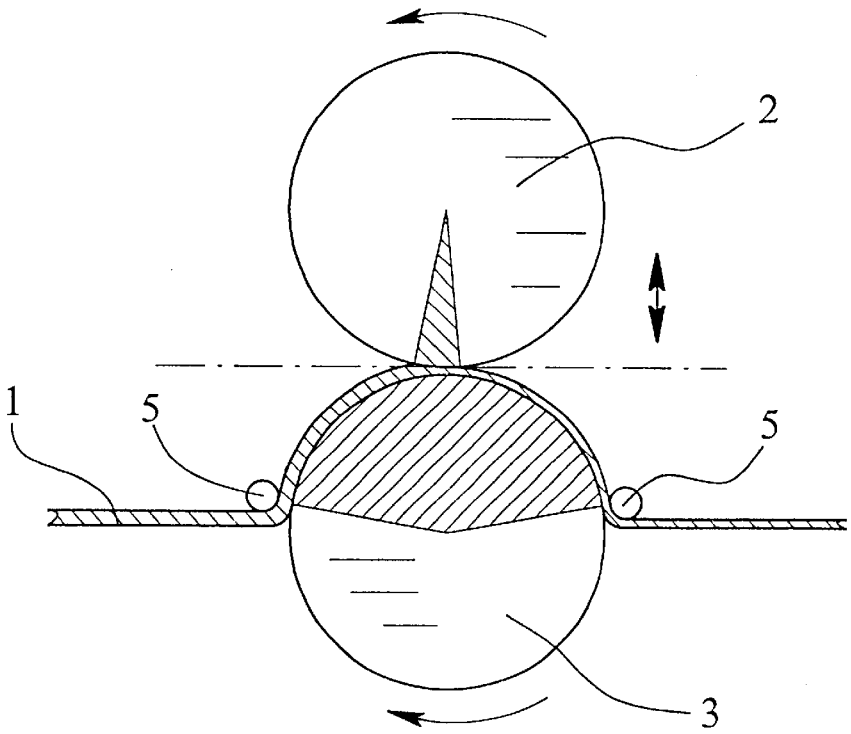
FIG. 2 is a schematic representation of a method and a device in accordance with a second preferred embodiment of the invention, wherein the metal band is subjected to an excursion from the checking line of the roll gap before and after the roll gap.

FIG. 2 shows a schematic representation of a method and a device in accordance with a second preferred embodiment of the invention. In this embodiment, the first working roll 2 and the second working roll 3 also have identical diameters. However, the first working roll 2 and the second working roll 3 are driven at the same circumferential speed.

In this embodiment, the longer time of contact between each point on the circumference of the second working roll 3 and the metal band 1 in comparison to the time of contact between each point on the circumference of the first working roll 2 and the metal band 1 which is required for obtaining the band sections with a lesser band thickness is realized due to the fact that one respective excursion device 5 is provided before and after the roll gap 4 formed between the first working roll 2 and the second working roll 3. In this case, both excursion devices 5 also have the shape of a roll and generate a force that is directed away from the first working roll 2 on the side of the metal band 1 which faces the first working roll 2. Due to this measure, the metal band 1 is forced to adjoin a circumferential region of the second working roll 3 which is significantly longer than the circumferential region of the first working roll 2.

In FIG. 2, this is indicated in the form of the hatched angles that correspond to the different circumferential regions in which the metal band 1 contacts the respective rolls. Due to the large contact region of the metal band 1 on the circumference of the second working roll 3, a flowing of the material cannot take place on the side of the metal band 1 which faces the second working roll 3 such that no band thickness transition is produced on this side of the metal band 1.

Figure 3:
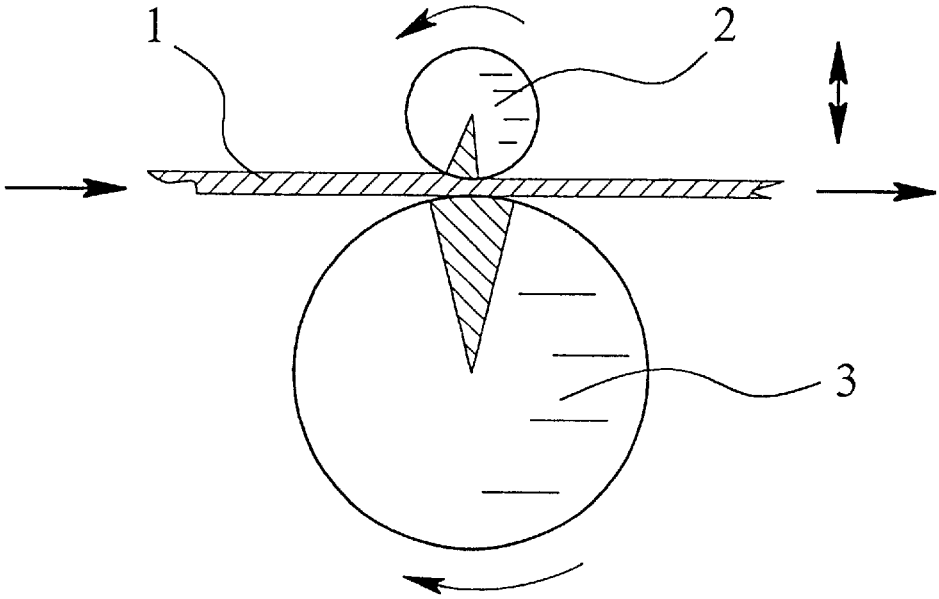
FIG. 3 is a schematic representation of a method and a device in accordance with a third preferred embodiment of the invention, wherein the working rolls have diameters that deviate from one another.

FIG. 3 shows a schematic representation of a method and a device in accordance with a third preferred embodiment of the invention. In this embodiment, the metal band 1 is guided between the first working roll 2 and the second working roll 3 along the checking line of the roll gap 4. The first working roll 2 and the second working roll 3 are driven at identical circumferential speeds. FIG. 3 shows, however, that the radius of the first working roll 2 is significantly smaller than the radius of the second working roll 3. Due to the smaller radius of the first working roll 2, the circumference of the first working roll 2 also has a more intense curvature. Consequently, the metal band 1 that is guided between the first working roll 2 and the second working roll 3 along the checking line of the roll gap 4 contacts the first working roll 2 with its side that faces the first working roll over a shorter length than with its side that faces the second working roll 3. This construction results in essentially the same effect as described above, namely that a flowing of the material of the metal band 1 which is in contact with the circumference of the second working roll 3 can be prevented such that the pressure exerted by the first working roll 2 upon the side of the metal band 1 which faces the first working roll merely results in the production of band thickness transitions on this side.

Figure 4:
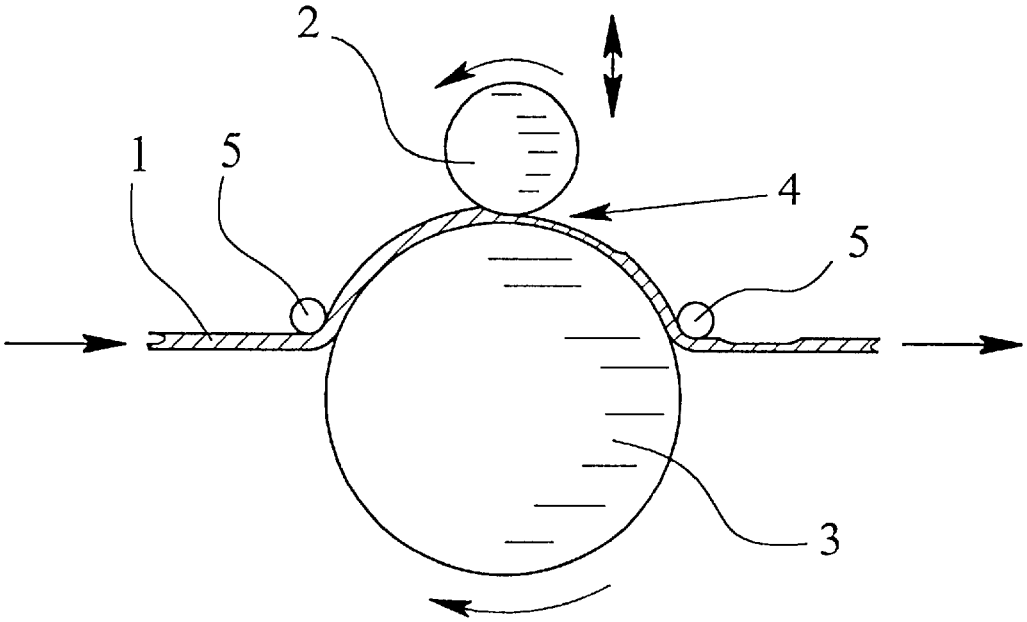
FIG. 4 shows a schematic representation of a method and a device in accordance with a fourth preferred embodiment of invention, wherein the diameters of both working rolls deviate from one another and an excursion of the metal band from the checking line of the roll gap takes place.

FIG. 4 shows a schematic representation of a method and a device in accordance with a fourth preferred embodiment of the invention. In this embodiment, excursion devices 5 are arranged before and after the roll gap 4. These excursion devices serve for subjecting the metal band 1 to an excursion out of the checking line of the roll gap 4 in the direction away from the first working roll 2. This results in a larger contact region between the metal band 1 and the circumference of the second working roll 3 in comparison to instances in which the metal band 1 is guided through the roll gap 4 along the checking line. In accordance with the fourth preferred embodiment of the invention, it is also proposed that the radius of the second working roll 3 is larger than the radius of the first working roll 2. This results in the contact region between the first working roll 2 and the metal band 1 being significantly smaller than the contact region between the metal band 1 and the second working roll 3. The method and the device in accordance with the fourth preferred embodiment of the invention practically represent a combination of the principles in accordance with the second and the third preferred embodiment of the invention.

While various embodiments in accordance with the present invention have been shown and described, it is understood that the invention is not limited thereto. These embodiments may be changed, modified and further applied by those skilled in the art. Therefore, this invention is not limited to the details shown and described previously but also includes all such changes and modifications which are encompassed by the appended claims.

What is claim is:

1. A method for flexibly rolling a metal band comprising the steps of:

providing a first working roll and a second working roll mounted in opposition to said first working roll, said first working roll and a second working roll having a roll gap formed therebetween;

rolling the metal band guiding the metal band through the roll gap formed between the first working roll and a second working roll;

varying the size of the roll gap in such a manner that band sections with a greater band thickness and band sections with a lesser band thickness are obtained over the length of the metal band, wherein, during the formation of band sections with a lesser band thickness, a time of contact between each point on the circumference of said first working roll and the metal band is shorter than the time of contact between each point on the circumference of said second of working roll and the metal band such that an asymmetric band thickness profile is obtained in a region of the band sections with a lesser band thickness; and wherein the metal band is subjected to an excursion from a checking line of the roll gap in a direction away from the first working roll at least one of before and after the first working roll and the second working roll.

2. The method in accordance with claim 1, wherein the time of contact between each point on the circumference of said first working roll and the metal band is of a short duration and the time of contact between each point on the circumference of the second working roll and the metal band is of a long duration relative to the time of contact between each point on the circumference of said first working roll and the metal band that band thickness transitions are exclusively produced on a side of the metal band which faces the first working roll.

3. The method in accordance with claim 2, wherein a circumferential speed of the first working roll is faster than the circumferential speed of the second working roll.

4. The method in accordance with claim 3, wherein in order to obtain the band sections with a lesser band thickness, the length of the metal band which is compressed by the first working roll is shorter than the length of the metal band which is compressed by the second working roll.

5. The method in accordance with claim 1, wherein the excursion of the metal band from the checking line of the roll gap is varied during the rolling process.

6. The method in accordance with claim 5, wherein the diameter of the first working roll is smaller than the diameter of the second working roll.

7. The method in accordance with claim 5, wherein the diameter of the first working roll is identical to the diameter of the second working roll.

8. A device for flexibly rolling a metal band comprising:

a first working roll and a second working roll mounted in opposition to said first working roll, said first working roll and said second working roll having a roll gap formed therebetween through which a metal band is guided in order to be rolled, wherein the size of said roll gap is variable in such a manner that band sections with a greater band thickness and band sections with a lesser band thickness are obtained over the length of the metal band, wherein means are provided for causing, during the formation of band sections with a lesser band thickness, a time of contact between each point on the circumference of said first working roll and the metal band to be shorter than the time of contact between each point on the circumference of said second of working roll and the metal band, such that an asymmetric band thickness profile is obtained in a region of the band sections with a lesser band thickness; and wherein said means for causing comprises an excursion device provided at at least one of before and after the roll gap formed between the first working roll and the second working roll.

9. The device in accordance with claim 8, wherein the means for causing is adapted to cause the time of contact between each point on the circumference of said first working roll and the metal band to be of a short duration and the time of contact between each point on the circumference of the second working roll and the metal band to be of a long duration relative to the time of contact between each point on the circumference of said first working roll and the metal band, such that band thickness transitions are exclusively produced on a side of the metal band which faces the first working roll.

10. The device in accordance with claim 9, wherein said means for causing is adapted to produce a circumferential speed of the first working roll which is faster than the circumferential speed of the second working roll.

11. The device in accordance with claim 10, wherein said means for causing is adapted to compress a shorter length of the metal band by the first working roll than a length of the metal band which is compressed by the second working roll.

12. The device in accordance with claim 8, wherein excursion device is adapted to subject the metal band to an excursion out of a checking line of the roll gap in a direction away from the first working roll at least one of before and after the roll gap.

13. The device in accordance with claim 12, wherein the excursion device is adapted to vary the extent of the excursion of the metal band during the rolling process.

14. The device in accordance with claim 13, wherein the diameter of the first working roll is smaller than the diameter of the second working roll.

15. The device in accordance with claim 13, wherein the diameter of the first working roll is identical to the diameter of the second working roll.

* * * * *